US005785551A

United States Patent [19]

Libby

[11] Patent Number: 5,785,551

[45] Date of Patent: Jul. 28, 1998

[54] QUICK CONNECT ELECTRICAL BOX

[76] Inventor: Robert A. Libby, 412 Oakland Ave., Williamsport, Pa. 17701

[21] Appl. No.: 411,950

[22] Filed: Mar. 28, 1995

[51] Int. Cl.[6] ..... H01R 13/66

[52] U.S. Cl. ..... 439/535; 439/418; 174/53

[58] Field of Search ..... 439/535, 676, 439/418, 425; 174/53

[56] References Cited

U.S. PATENT DOCUMENTS

| | | | |
|---|---|---|---|
| 3,641,472 | 2/1972 | Phillips, Jr. | 339/10 |
| 3,716,651 | 2/1973 | Werner | 174/53 |
| 3,828,113 | 8/1974 | Bourne | 174/55 |
| 4,165,443 | 8/1979 | Figart et al. | 174/53 |
| 4,336,418 | 6/1982 | Hoag | 174/53 |
| 4,477,141 | 10/1984 | Hardesty | 339/122 R |
| 4,485,282 | 11/1984 | Lee | 200/51 |
| 4,634,212 | 1/1987 | Boundy et al. | 339/198 R |
| 4,842,551 | 6/1989 | Heimann | 439/502 |
| 4,918,258 | 4/1990 | Ayer | 174/53 |
| 4,924,032 | 5/1990 | Akins | 174/53 |
| 4,958,048 | 9/1990 | Bell | 174/53 |
| 5,015,203 | 5/1991 | Furrow | 439/535 |
| 5,064,385 | 11/1991 | Harlow, Jr. | 439/535 |
| 5,178,555 | 1/1993 | Kilpatrick et al. | 439/215 |

*Primary Examiner*—Gary F. Paumen
*Attorney, Agent, or Firm*—Thomas R. Shaffer, Esq.

[57] ABSTRACT

An electrical box is pre-wired with a duplex receptacle, a light switch, a junction or the like. The box has a number of connectors, each having electrical contacts. The connectors receive complementary plugs having terminals which make an electrical connection between the pre-wired box and the conductors of the electrical cable. The plug is attached to an unstripped end of an electrical cable, preferably by crimping to engage through the sheathing and conductor insulation. The connectors are pre-wired for a range of functions and are labeled with indica symbolizing the function assigned to the connector. During construction, preferably prior to installation of a wall panel, electrical cables are run from a power source to locations designated to receive an electrical box. A hole is made in the wall and the previously installed cable is located and pulled out through the hole. The plugs are installed on the ends of cables to be coupled to the box and the plugs are inserted into the appropriate connector on the box. The box has a retaining means which is operable to retain the box within the hole cut into the wall. The box is inserted into the hole and the retaining means is engaged with the wall panel to fix the box in the wall.

18 Claims, 12 Drawing Sheets

QUICK CONNECT ELECTRICAL BOX

BACKGROUND OF THE INVENTION

1. Field of the Invention

The invention relates to electrical power distribution systems for buildings such as residences and commercial buildings, and in particular concerns a wiring and distribution box arrangement having pre-wired receptacle, switch and/or junction means disposed in a wall mountable box, and means for making plug-like connections with conductors for coupling the pre-wired means into the power distribution circuit. The invention substantially reduces the time, skill and labor normally required for permanent installation of electrical boxes in a branch circuit.

2. Prior Art

Wiring the various branch circuits of a typical 120 volt AC electrical power distribution system is a time consuming and labor intensive job. This is the case, in part, because individual attention is required to the placement and the attachment of every cable, junction box, plug receptacle, fixture, switch and the like, as well as every termination of every conductor associated therewith. In addition, accommodation often must be made for the fact that other building operations are going on concurrently with wiring, such as the installation of wall panels.

In construction of a new home, for example, wiring is completed in stages. After rough framing and prior to attachment of wall panels to the frame (e.g., dry wall or plaster), most or all of the power distribution cables are installed between a main service panel or breaker panel at a service entrance coupled to the utility company, and the locations of various outlet receptacles, switches, fixtures and the like. Each receptacle, switch, and fixture in the home is a member of a branch circuit connected to a circuit breaker in the main service panel, the branch circuits typically encompassing a plurality of receptacles, switches and/or fixtures that are related to one another by function or by general location.

The term "receptacle" in this context generally refers to a standard duplex receptacle operable to receive a standard 120 volt AC two prong or three prong grounded plug, or similarly to a 240 volt outlet suitable for appliances, including those equipped with ground fault interrupters, etc. The term "switch" generally refers to a standard 120 volt AC light switch or the like, as well as three way, four way and dimmer switches, and similar means intended to permit the resident or user to control loads coupled to the branch circuit. The term "fixture" generally refers to a lighting fixture or the like, often located in the ceiling, which is wired into the structure of the establishment, as opposed to being coupled to the branch circuit by a flexible cord leading through the living space to a receptacle or the like.

Some branch circuits advantageously are wired with a metal sheathed cable commonly called armored BX cable. Armored cable is durable but is difficult to work with, requiring a hacksaw or the like to cut through the armor, and is therefore only used to protect especially vulnerable and/or exposed cable runs. Most 120 volt AC branch circuits are wired using TYPE-NM (non-metallic sheathed) cables with two conductors plus a ground, often called "Romex". Residential and commercial Romex cable typically contains 12 or 14 gauge solid core conductors, depending on current loading requirements. Cabling with 14 gauge conductors is suitable for branch circuits carrying 15 amps or less. Cabling with 12 gauge conductors is suitable for branch circuits carrying up to 20 amps. Other gauges are of course possible.

Each room in the home typically has several receptacles, at least one light switch and one or more lighting fixtures, and electrical codes may define a maximum spacing between receptacles or a minimum number per room. Preferably after rough framing, a metal or plastic electrical box is rigidly attached to the framing in the home at each location to have a receptacle, switch, junction box or fixture.

Various specific box structures are available, such as double, triple or quadruple-wide boxes, single boxes which can be ganged together, boxes with flanges to facilitate attachment to the framing members, boxes which can be mounted in the ceiling for lighting fixtures, weatherproof boxes for outdoor use, as well as junction boxes for coupling two or more cables. A typical flanged metal electrical box is shown being nailed to a framing member in FIG. 1. The electrical box is installed to a framing member such that the front open face of the box protrudes from the plane of the framing members a distance equal to the thickness of the wall material, such as ½" if the wall material is ½" dry wall.

One or more cables are routed through the framing of the house to the appropriate electrical box. The cables are pulled though openings in the rear or sides of the electrical box as shown in FIG. 2, and usually a cable clamp is provided to secure the electrical cable to the box such that tension cannot disturb wiring connections made within the box. The cable clamp may be attached by a screw disposed adjacent a knock-out plug, or a threaded cable clamp with a nut can be engaged in a hole in the box, for example at a knock-out plug. The cable is fed through an opening in the clamp to leave a sufficient tail for making connections. The clamp is then tightened down so that the cable cannot be pulled back though the opening.

At least one of the cables entering the box is more proximal to the main service panel and is typically called the feed cable. A second cable may be required to route power further to a more distal electrical box or fixture along the branch circuit (such as a switched fixture or a parallel receptacle in the same branch).

Initially, the cables are not terminated. As shown in FIG. 2 the tail length of each cable (approximately one foot) is left dangling though the opening in the front of the box or folded back into the box to be out of the way. The wiring of the switch, receptacle or fixture is typically not done until after wall panel installation and finishing steps are complete. A typical four bedroom home may have more than 40 electrical boxes for receptacles, switches, and fixtures, etc. Each one of these electrical boxes has at least one cable which is subsequently wired to a receptacle element, switch, or fixture mounted in or on the electrical box.

According to standard procedure, the wall panels are installed after the electrical boxes have been mounted and the wiring is placed and clamped, leaving wire tails. Wherever a wall panel (for example of drywall or other panelling) is to be disposed over the electrical box location, a carefully measured and placed hole or cutout must be provided such that when installed, the panel abuts at the edges of the protruding electrical box while allowing access to the open front of the electrical box. Assuming the electrical box and wall panel have been mounted properly, the front open surface of the electrical box is flush with the plane of the wall panel. If a hole is not cut with precision, the hole and the protruding electrical box will not line up. The hole may have to be trimmed or enlarged to fit properly around the electrical box and the wall area surrounding the electrical box may have to be repaired prior to finishing the wall. A significant amount of skilled labor is required to properly mount wall panels on framing members with previously attached protruding electrical boxes.

Electrical connections between and among the cable conductors and the terminals of each switch or receptacle element are then completed one conductor at a time. With reference to FIGS. 3 to 8, several steps are required to complete each receptacle. First the outer sheath of the electrical cable is slit and removed as shown in FIG. 3, for example with a cable ripper which has a small cutter designed to slice though the outer sheathing without damaging the insulated conductors within. A knife can be used for this purpose, however the risk of damaging the insulated conductors is increased.

The outer sheathing, such as an outer plastic and inner paper wrap, are cut away, usually leaving at least three conductors as shown in FIG. 4. Two or three of the conductors have color coded insulation, white insulation denoting the neutral conductor, black insulation the hot conductor, and red, if provided, denoting a switched conductor. The third conductor is usually an uninsulated ground conductor.

The inner insulation is stripped from the ends of the hot and neutral conductors as shown in FIG. 5, preferably using a wire stripper which is adjusted to cut though the insulation without nicking the conductor, but also possibly with diagonal cutters or a knife. Although the conductors are rather durable, a nick at the end of the inner insulation can severely weaken the conductor and lead to failure.

The hot and neutral conductors are formed into a hook with a pair of needle nose pliers as shown in FIG. 6, large enough to conform to the diameter of terminal screws located on the side of a typical switch or receptacle. The screws are also color coded, the silver colored screw denoting neutral and a copper (gold) colored screw denoting hot (alternatively copper and black may be used, respectively). The appropriate screw for the respective conductor is loosened on the switch or receptacle device. The hook formed in the conductor is placed around the screw under the screw head as shown in FIG. 7, and preferably pinched down. The hook should be oriented in the proper direction (i.e., wrapping clockwise for a right-handed screw thread) so that the wire hook is not opened or forced out from under the screw head as the screw is tightened.

Alternatively the receptacle can be "backwired," which involves inserting stripped straight lengths of the conductors endwise into openings with spring contacts that bear against the stripped conductors. Duplex receptacles capable of backwiring are available, for example, from Leviton Manufacturing Co., Little Neck, N.Y.; and GE Wiring Devices, Warwick, R.I.; etc. The ends of the conductors are stripped over the precise length needed to fit in the openings such that the insulation behind the stripped end reaches just to the surface of the opening. Such receptacles generally provide a strip gauge molded into the back of the receptacle which indicates the proper length of insulation to be stripped. If too much insulation is stripped from the conductor, the stripped end bottoms out in the opening and a portion of the bare conductor remains exposed. If too little insulation is stripped from the conductor the conductor may not be adequately retained in the hole. Of course, it remains necessary with backwired devices to ensure that the proper conductor (hot or neutral) is placed in the corresponding opening.

The uninsulated ground wire must also be attached to the ground terminal of the receptacle in similar fashion as shown in FIG. 8. If the electrical box is made of metal, the box must be grounded by a connection to the ground terminal or to the ground conductor. Typically, the ground conductor is simply routed around a screw located inside the box (e.g., the cable clamp screw) and then to the ground terminal of the receptacle.

When two or more cables are routed to the box, a different grounding arrangement must be used. After routing at least one ground conductor to the box, the remaining ground conductors are twisted together and capped with a wire nut. A special wire nut (usually green in color) with a hole for a pigtail can be used to hold the ground conductors together. A pigtail of appropriate length, with a stripped end if insulated, is fed into a small hole in the closed end of the wire nut, the large open end of the wire nut is then twisted over the ground conductors and the pigtail is attached to the grounding terminal of the receptacle. Alternatively a crimp connector and pig tail lead can be used to join the ground conductors together.

The conductors are folded back neatly and the receptacle is pushed into the electrical box. Two retaining screws are installed to hold the receptacle in the box as shown in FIG. 9. Care must be taken to center and align the receptacle at the correct position in the electrical box. Once the receptacle is properly oriented in the box the cover plate can be attached as shown in FIG. 10.

These routine steps involve substantial time and care to accomplish properly. Adding a second cable to a box multiplies the required steps, particularly when the duplex receptacle is used for two-circuit wiring. Although a duplex receptacle has two outlets which are usually powered from the same source, this is not always the case. Duplex receptacles can have a break-off fin located between the pair of side screws, acting as a bus bar between the pair of side screws. The break-off fin can be removed to electrically isolates the pair of side screws and allows the two individual receptacles to be wired individually, for example so that only one is controlled by a switch. Rooms that do not have a center fixture in the ceiling are often wired with one or more two-circuit receptacles for lamps. Two-circuit receptacles are also used in kitchens, such that load devices which require large amounts of power, such as refrigerators, microwave ovens and toasters, can have a separate branch circuit to accommodate their current requirements while using only one receptacle circuit.

Attempts have been made to simplify the wiring process. U.S. Pat. No. 3,716,651—Werner discloses a wiring box that has screw terminals for attaching cables and spring clips for attaching receptacles. The receptacles have corresponding prongs which mate with the spring clips. First the box is mounted and wired using the screw terminals. Then the receptacle is pressed into the box such that the prongs engage in the spring clips thereby making electrical contact. Although Werner eliminates wiring between the box and the receptacle, the receptacle must still be installed and aligned in the box, and the box itself must be wired in a manner similar to a conventional receptacle.

U.S. Pat. No. 4,485,282—Lee discloses a plug-in system for wiring wall outlets and wall switches. The system has a base plate which is wired by inserting the stripped ends of the conductors into frictionally engaging electrical contacts in a manner similar to backwiring a duplex receptacle. The base plate has two openings in the front each opening having a series of electrical contacts that are operable to engage a plug-in module. Once the base plate is wired, the proper module is selected, such as an outlet or a switch, to be inserted into the openings.

U.S. Pat. No. 4,165,443—Figart et al also discloses a system which has a backwired baseplate and separate plug-in modules for receptacles and switches. Figart also discloses several labeled backwire terminals which simplify the wiring connections. For example two terminals are labeled "to fixture" and "power" to identify which cable should be connected to the box if a switch module is to be installed. Other terminals are marked to aid in the wiring of three way switches an four way switches. The stripped ends of the conductors are inserted into the appropriately marked terminals. The appropriate three way or four way switch modules are then plugged into the baseplate to complete the circuit. This type of system simplifies the interconnection for more sophisticated wiring situations, however there is added complexity due to having an electrical box having a baseplate and separate plug-in modules, and attention is required to comply with the labeled requirements to couple certain conductors to certain connections.

U.S. Pat. No. 4,336,418—Hoag, U.S. Pat. No. 4,918,258—Ayer and U.S. Pat. No. 4,924,032—Akins also disclose wiring systems in which connections are made by inserting the stripped ends of the conductors into frictionally engaging electrical contacts similar to backwiring a duplex receptacle.

U.S. Pat. No. 4,842,551—Heimann discloses a modular plug suitable for connection to an electrical cable. The individual conductors in an electrical cable are stripped and inserted into a first end of the plug. The opposite end of the plug has an interconnector plug which is attached to several short conductors. The interconnector plug is then engaged into a socket in the rear surface of a function module, such as a receptacle or a switch. After the interconnector plug is engaged in the function module, the function module must be aligned and installed in the electrical box.

U.S. Pat. No. 3,641,472—Phillips Jr., U.S. Pat. No. 5,178,555—Kilpatrick et al., and U.S. Pat. No. 5,015,203—Furrow disclose 120 volt AC electrical boxes with a front wall having standard three-prong receptacles and a rear wall having a male terminal that connects to female plugs. In Phillips, the female plug is a standard three-prong receptacle typical of 120 volt AC outdoor extension cords. Kilpatrick et al. and Furrow disclose for the modular plug a different type, namely multi-pin connector types which are customary in connecting together computer hardware. These references all disclose female modular-plugs which would at best be laboriously attachable to an end of Romex cable or like conductor-cable.

U.S. Pat. No. 5,064,385—Harlow, Jr., discloses in FIG. 2 a modular junction box which is releasably connectable to a modular outlet box. The junction box has a socket for insertion of a modular plug on an end of insulated electrical cable. The modular plug requires the conductors of the electrical cable to be stripped of insulation before assembly. Harlow, Jr. also discloses a wire stripper in designed specifically to strip the individual conductors in preparation for attachment of the modular plug.

It would be desirable to reduce and simplify the number of steps required in wiring an electrical power distribution system. It would be desirable to make electrical connections without the need to strip the ends of the individual conductors in an electrical cable. It would also be desirable to eliminate the need to align receptacles or switches with an electrical box. It would further be desirable to install electrical boxes after the walls panels are installed, to avoid the need to match wall panel holes to fixedly mounted and protruding electrical boxes.

SUMMARY OF THE INVENTION

It is an object of the invention to provide an electrical box which is pre-wired, for eliminating the need to make conductor junctions in the box at the time of installation.

It is another object of the invention to provide a set of electrical boxes which are pre-wired for alternative standard connections, for example for grounded duplex receptacles, junctions of two or more cables, or three way and four way switch arrangements.

It is another object of the invention to provide an electrical box which permanently aligns a pre-wired receptacle or switch with respect to the box thereby eliminating the need for alignment during installation.

It is another object of the invention to provide an electrical box which is easily attached to standard electrical cable such as Romex in a substantially foolproof manner.

It is another object of the invention to provide an electrical box which has a plurality of female connectors operable to mate with a male plug, thereby eliminating the need to handle the individual conductors or to choose particular conductors for attachment to particular terminals.

It is another object of the invention to provide an electrical box which has a plurality of connectors operable to mate with a male plug which is easily attached to an unstripped end of electrical cable.

It is another object of the invention to provide an electrical box which has a plurality of connectors operable to mate with a male plug connector which has an integral retaining means thereby eliminating the need for additional cable clamps or strain relief mechanisms for preventing retraction of a cable from its connections and to avoid disturbing junctions subject to disconnection via tension.

These and other objects are accomplished by an electrical box, or set of electrical boxes, pre-wired, for example, with one or more of a duplex receptacle, standard light switch or three way or four way light switch. Alternatively the box can be wired as a junction box for coupling two or more cables. The box has a plurality of connectors, each having a plurality of electrical contacts, that mate with complementary connectors, each having a plurality of terminals, to make an electrical connection with the conductors of the electrical cable. The connectors can be asymmetrically mixed male and female fittings that each complement their mating connector (e.g., two adjacent males and a female vs. two adjacent females and a male), whereby the connectors are attachable only in one direction.

According to a preferred embodiment, a male plug is attached to an unstripped end of the electrical cable, preferably by crimping, and couples with a female plug on the box. The plug has a first retaining means which mechanically couples the plug to the sheathing of an electrical cable. The plug mates with the female connector in the box, the contacts making electrical contact with the terminals of the plug, thereby electrically connecting the conductors of the electrical cable with the electrical connections pre-wired into the box. The male plug also incorporates a second retaining means which cooperates with the female connector so that when the plug is mated in the female connector, the plug and the electrical cable are mechanically attached to the box. The second retaining means eliminates the need for ancillary strain relief mechanisms such as cable clamps.

The plurality of female connectors can be pre-wired for a range of functions and in that case are labeled with indicia symbolizing the function assigned to the connector such as COMMON, 3 WAY IN, 3 WAY OUT, TOP RECEPTACLE, etc. The term "COMMON" denotes a connector operable to receive an electrical cable originating from a power source, such as the main service panel or a cable which is to be routed to an electrical box which requires an unswitched feed, such as subsequent receptacle in a branch circuit. The term "3 WAY IN" denotes a connector operable to receive an electrical cable which is to be connected to the input terminal of a three way switch (neutral terminal). The term "3 WAY OUT" denotes a connector operable to receive an electrical cable which is coupled to the output terminals of a three way switch (two hot terminals). The "TOP RECEPTACLE" denotes a connector operable to receive an electrical cable originating from a power source which will provide a feed for the upper outlet for a two-circuit receptacle. It is appreciated that the above indicia are illustrative only and that other indicia can be provided to correspond with various functions pre-wired into the electrical box.

During construction, prior to the installation of the wall (such as a dry wall panel or plaster), electrical cables can be routed from the main service panel to the general locations designated to receive an electrical box. Junction boxes that do not require access can also be installed at this time.

The electrical box is installed in a hole in the wall. The hole can be cut into the wall panel before or after the wall panel is attached to the framing members. The hole does not require precise positioning relative to the studs or other framing members, and is cut in the wall with a razor knife, or dry wall saw or the like, at a desired location (provided that such location does not overlap a stud). The cable, which was previously installed behind the wall, is located and pulled out through the hole. Male plugs are installed on the cable or cables and the plugs are inserted into or mated with the appropriate female connector. The box has a retaining means which is operable to retain the box within the hole cut into the finished wall. The box is inserted into the hole and the retaining means is engaged so that the box is firmly retained in the wall.

Installation of electrical boxes continues until all of the designated locations are wired. A simple branch circuit with four receptacles is connected as follows. Prior to installation of the wall, a cable is run from the main service panel to the designated location for the first receptacle in the branch. Although a slack loop is preferably provided, the cable is not cut at this time. The cable is further routed to the second, third and fourth designated locations to the end of the branch circuit, in each case leaving a slack loop, or at the end, a tail. After the wall panel is installed, a hole is cut in the wall in the designated location for the first receptacle. A loop of cable is pulled through the hole and the cable is cut. Two male plugs are crimped onto the cut ends of the cable. The plug coupled to the length of cable routed to the main service panel is plugged into one of the "COMMON" connectors on the back of an electrical box pre-wired with a receptacle. The plug coupled to the length of cable routed to the designated location for the second receptacle is also plugged into one of the "COMMON" connectors. The electrical box is then pushed into the hole and the retaining means is engaged so that the box is fixed in the wall. The same procedure is followed for the remaining three receptacles, however the fourth receptacle of course requires only one plug coupled to the previously cut end of the cable. This plug is inserted into the COMMON connector of the fourth receptacle.

Whereas the boxes and connectors define the required wiring elements and functions, and are readily plugged in, no attention is required to individual connectors apart from attaching the connectors to the cables. Whereas the box is not preliminarily fixed to a stud, additional freedom in locating the wall panel hole is provided. The connectors engage mechanically to guard against detachment due to cable tension, and the installer is not required to lock the cable end via a cable clamp. Therefore, many of the reasons that conventional wiring requires time and careful attention are alleviated.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings, FIG. 1, labeled as prior art, is a perspective view of a standard flanged metal electrical box which is attached to a framing member using a hammer and nail.

FIG. 2 is a perspective view of the box of FIG. 1, mounted to protrude through a hole in the wall panel and having two electrical cables pulled in.

FIG. 3 illustrates slitting the outer sheath of the cable with a cable ripper.

FIG. 4 illustrates removing the outer sheath using diagonal cutters.

FIG. 5 illustrates stripping the internal insulation from the ends of individual insulated conductors.

FIG. 6 illustrates forming the stripped ends of the conductors into hooked shapes.

FIG. 7 illustrates attaching the hooked ends under a side screw of a standard duplex receptacle.

FIG. 8 illustrates making a ground connection to a side ground terminal of the receptacle using a screwdriver.

FIG. 9 illustrates inserting the receptacle into the box, aligning it with the plane of the wall, and attachment with screws.

FIG. 10 illustrates attachment of a cover plate.

DETAILED DESCRIPTION OF THE PREFERRED EMBODIMENT

Figure 11B:
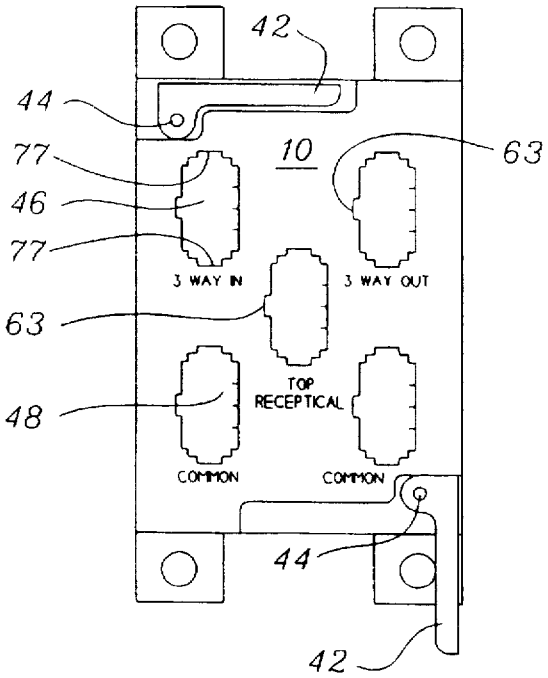
FIG. 11*b* is rear view of the electrical box in accordance with the invention.
Figure 11A:
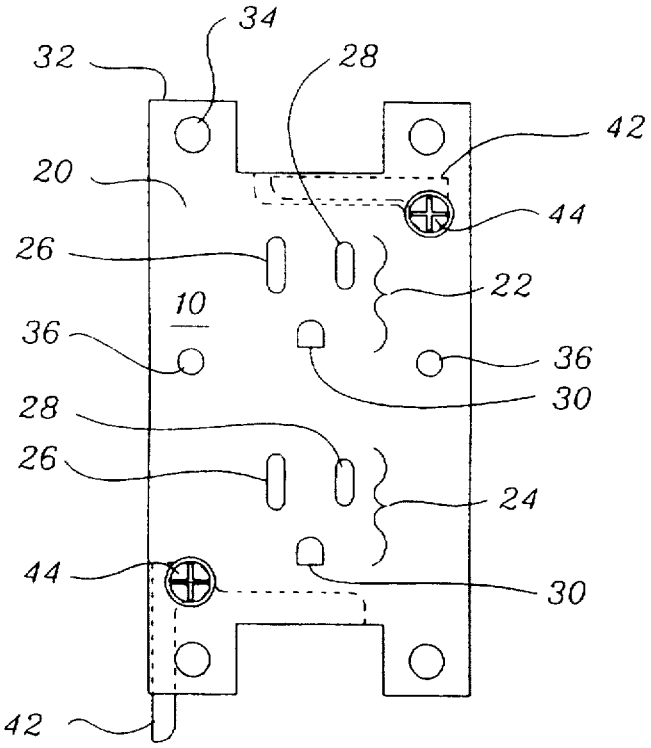
FIG. 11*a* is front view of the electrical box in accordance with the invention.
Figure 11D:
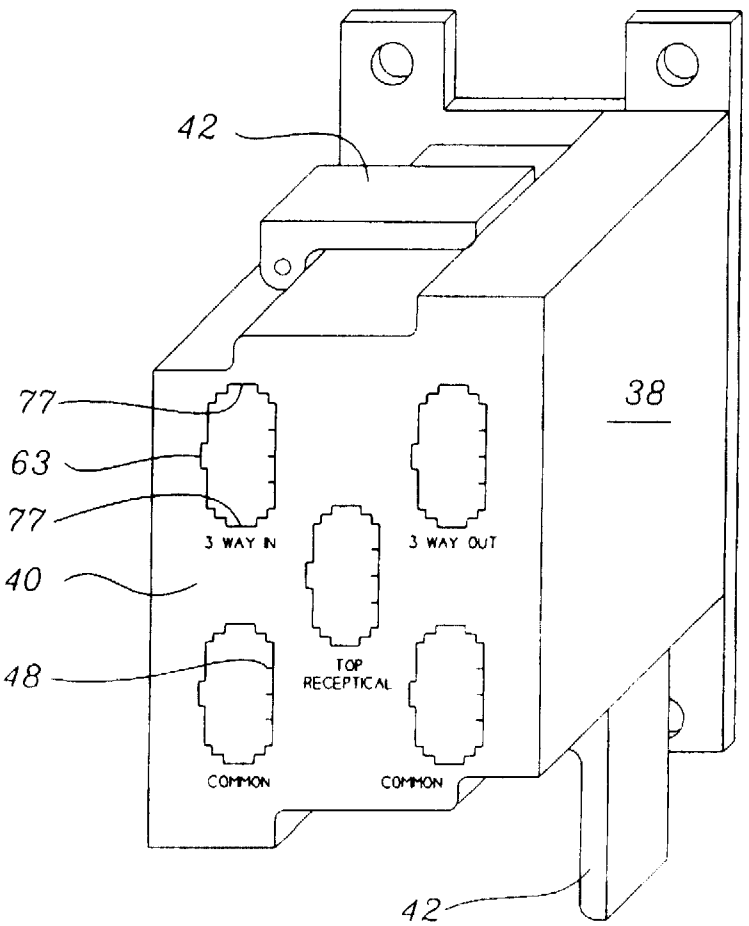
FIG. 11*d* is rear perspective view of the electrical box of FIG. 11*b*.
Figure 11C:
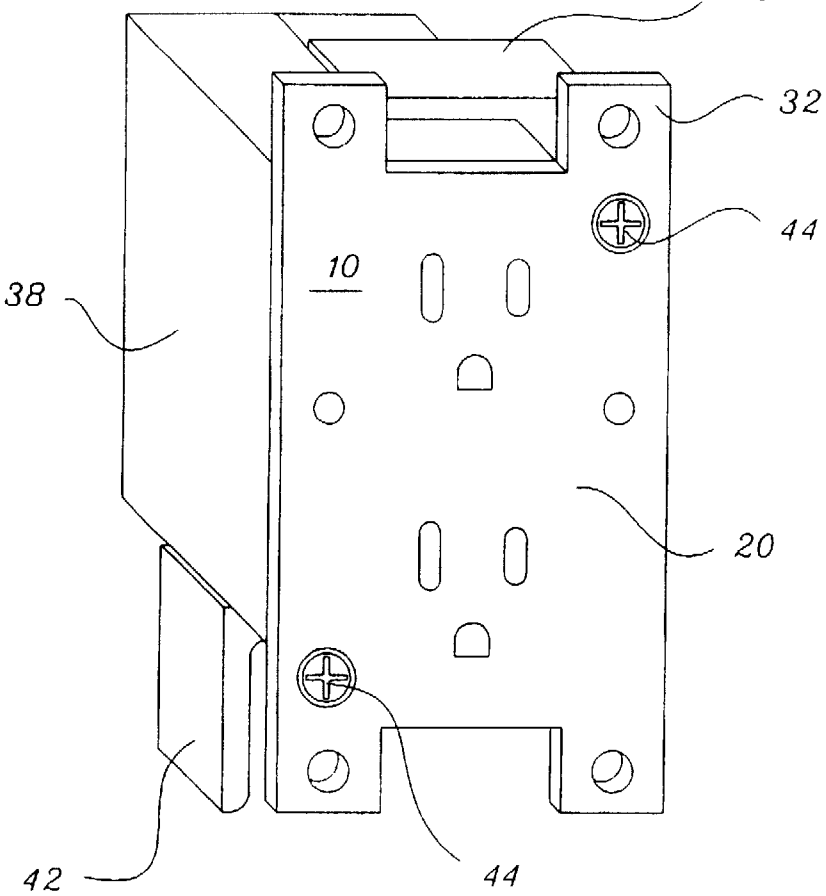
FIG. 11*c* is a front perspective view of an electrical box of FIG. 11*a*.

FIG. 11*a* shows a front view of an embodiment of an electrical box 10 in accordance with the invention. The electrical box has a front surface 20 which is formed into a duplex receptacle. The duplex receptacle has two individual outlets 22, 24 each having a long slot 26 behind which is located a first contact (not shown) which is operable to make an electrical connection to the neutral conductor in a branch circuit, a short slot 28 behind which is located a second contact (not shown) which is operable to make an electrical connection to the hot conductor in the branch circuit, and a hole 30 behind which is located a third electrical contact (not shown) which is operable to make an electrical connection to the ground of the branch circuit. The front surface also has four mounting tabs 32, one in each corner, each tab being formed with hole 34. The two cover plate mounting holes 36 which are operable to receive screws for attachment of an optional cover plate which at least partially covers the front surface and can be used to alter the color or appearance of the front surface. As shown in FIGS. 11*c* and 11*d*, the box has a four side members 38 which form the body of the box and a rear surface 40 (FIG. 11*d*) which in conjunction with the front and the sides forms a hollow enclosure.

The invention is described with reference to a standard form of outlet or receptacle as used for 120 volt alternating current. It will be appreciated that devices intended for other voltages or devices intended to permit higher currents than typical of domestic and commercial power distribution are also possible (e.g., 240 volt arrangements), as well as other receptacle type devices (e.g., ground fault interrupter receptacles).

The mounting tabs 32 provide at least two functions. First, the mounting tabs prevent the box from being pushed though a hole in the wall into which the box is to be mounted. Second, the holes 34 in the mounting tabs are operable to accept fasteners such as screws or nails which are used to anchor the box to a wall. Fasteners can only be used to attach the box to a wall capable of holding the fastener, such as wood paneling. Walls constructed from dry-wall panels or plaster or the like require an alternative means for mounting the box.

The box has a two slidable and pivotable retaining wings 42 each of which is attached to a screw 44. This type of retaining means is known in the art for retro-fitting receptacles after wall panels are installed, generally requiring that cables be fished vertically between framing studs. The retaining wings 42 are carried on screws 44 and are operable to pivot between a folded and operating position. FIGS. 11*a*–11*d* show an upper retaining wing in the folded position and a lower retaining wing in the operating position. In the operating position, the wings are pulled forward by the screws to clamp against the rear side of the wall panel. The retaining wings are suitable for holding the box into a hole cut into relatively fragile wall materials such as dry wall, plaster and the like. The retaining wings remain in the folded position, flush with the body of the box, as the box is inserted into a hole in the wall until the mounting tabs contact the front surface of the wall. Turning the screws clockwise pivots the retaining wings open into the operating position, where they are stopped, and further threading with the wings now fixed against rotation, draws the wings towards the front surface of the box and eventually contact and clamp the wall panel adjacent the opening, between the wings and the tabs, thereby anchoring the box to the wall.

As shown in FIGS. 11*b* and 11*d* the rear surface 40 of the electrical box is formed with a plurality of connectors 46 operable to mate with a complementary plug that is affixed to a cable end as discussed below. In the embodiment shown, the connectors on the rear surface of the box are female. Each female connector 46 has contacts 48 which are electrically connected to at least one of the first, second and third contacts located behind at least one of the individual outlets of the duplex receptacle. Each female connector 46 has a notch 63 or keyway which is operable to receive a raised rib or key such that the complementary plug can only be engaged in the connector in single orientation (i.e., polarized). Each female connector has at least one recess 77 which is operable to receive a wing member formed in the complementary plug thereby retaining the plug in the connector. Each of the plurality of female connectors are labeled with indicia 50 as discussed in more detail below.

Figure 13A:
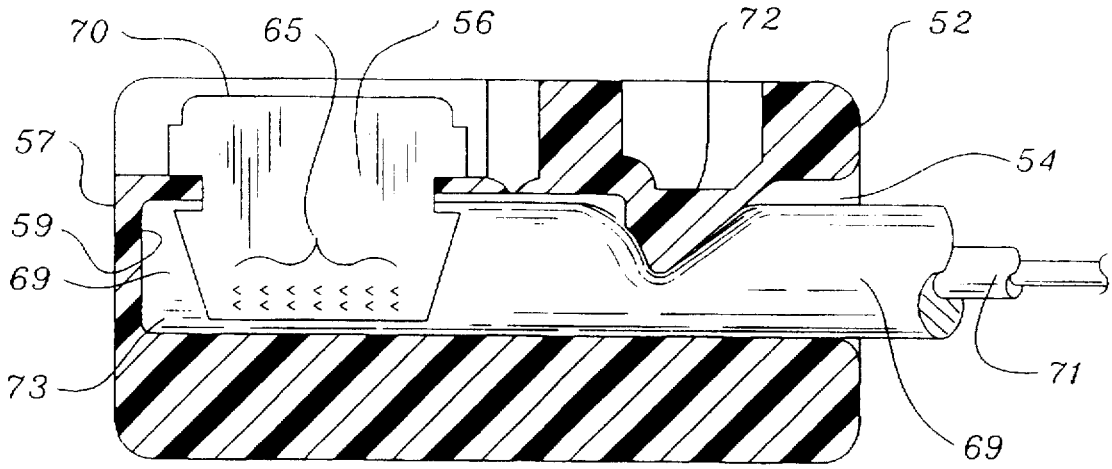
FIG. 13*a* is a side view a male plug in accordance with the invention, the female plug being complementary to the end shown on the left in FIGS. 13*a* and 13*b*.
Figure 13B:
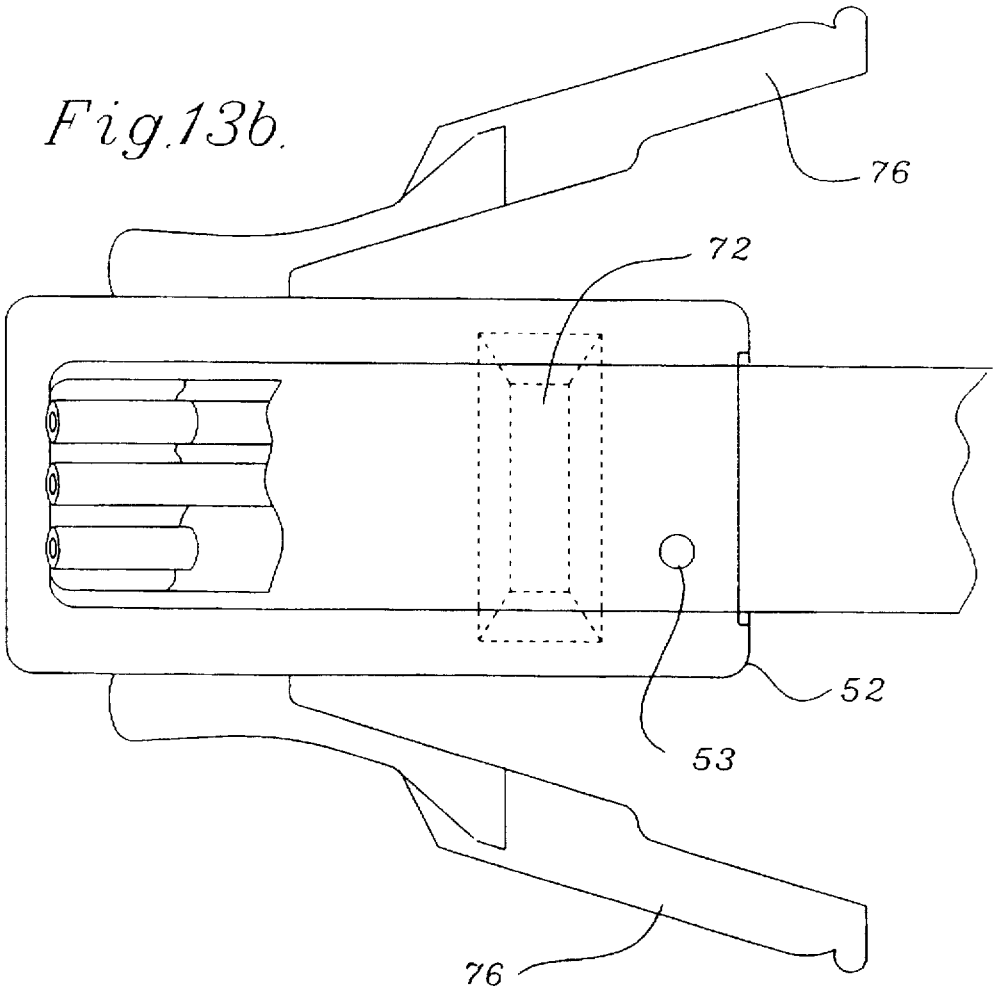
FIG. 13*b* is a top view of the male plug of FIG. 13*a* in accordance with the invention.
Figure 13C:
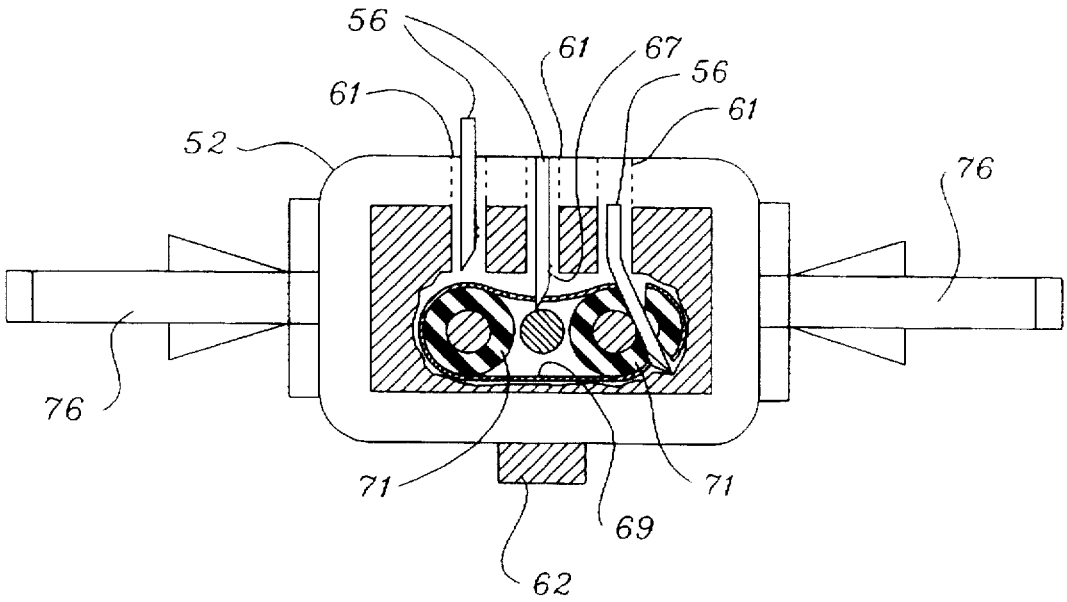
FIG. 13*c* is a front sectional view of the male plug of FIG. 13*a* in accordance with the invention.

FIGS. 13*a*–13*c* show an embodiment of the male plug 52 which is operable to connect to an unstripped end of electrical cable. The plug is suitable for connection to virtually any type of electrical cable such as 12 gauge two wire plus ground non-metallic sheathed cable or Romex. The male plug is formed with an opening 54 in a first end which is operable to receive a cut end of electrical cable. The second end of the male plug 57 has an abutment 59 which is operable to limit the distance the electrical cable can be pushed into the plug. The second end is also formed to accept at least one movable terminal 56. The terminal is movably engaged in a channel 61 which is aligned with at least one conductor in an electrical cable inserted into the opening 54 such that the terminal can reciprocate towards and away the conductor. The terminal is operable to make electrical connection with the conductor and also make electrical connection with at least one of the contacts of the female connector located in the rear surface of the electrical box.

Although in this embodiment the box connectors are female and the cable connectors are male. The gender of the connectors can be arranged otherwise, provided the box and cable connectors are complementary. In order to ensure that the correct cable conductors are coupled to the corresponding terminals, the connectors can be asymmetrical. FIG. 13*c* shows a front view of the plug 52 having a raised rib 62 which fits the notch 63 formed in the female connector thereby insuring the proper polarization of the plug relative to the connector. It will be appreciated that other methods of keying plugs and connectors are possible so that proper polarization of the plug is insured. For example, keyed plugs and connectors can be formed with an asymmetrical arrangement of male and female connector parts, i.e., one of the connectors can have two adjacent males and a female, and the other can have two adjacent females and a male, thereby ensuring that the connectors can be attached only one way.

As shown in FIG. 13*b* the exterior surface of the plug is marked with indicia symbolizing the orientation of the conductors of the electrical cable within the plug. The indicia is shown as a single black dot 53 which symbolizes the proper orientation of the hot wire (normally covered with black insulation). It is appreciated that a variety of additional indicia could be used such as a white dot symbolizing the proper orientation of the neutral wire, or in applications where three conductor wire is used, a red dot symbolizing the proper orientation of the second hot wire.

The plug as shown in FIGS. 13*a*–13*c* has three terminals 56. It is appreciated that additional terminals can be provided. With the addition of a fourth terminal the plug is suitable for use with three conductor wire (three conductors plus a ground). Similarly, the opening 54 in the rear of the plug can be of varying dimension to accommodate larger or smaller gauge conductors.

Figure 1:
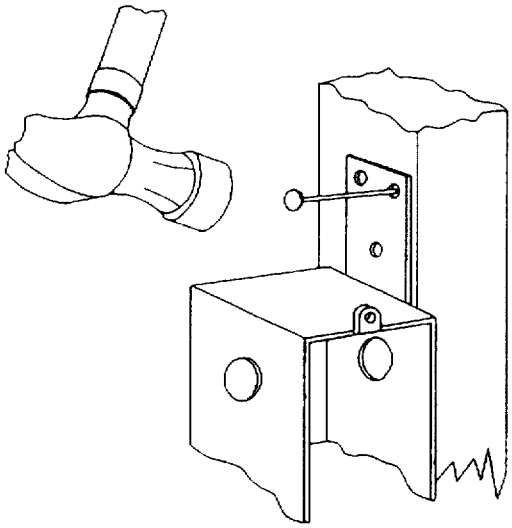
Fig.1. Prior Art
Figure 2:
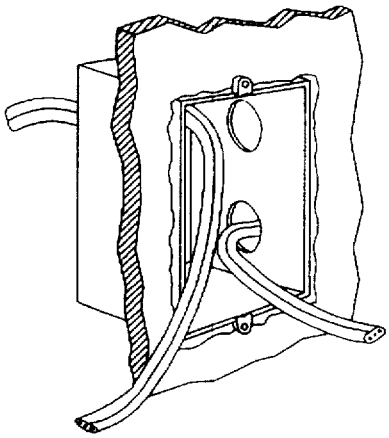
Fig.2. Prior Art
FIGS. 2 through 10, labeled as prior art, illustrate mounting, wiring and attachment steps for installing a conventional electrical receptacle. In particular.
Figure 4:
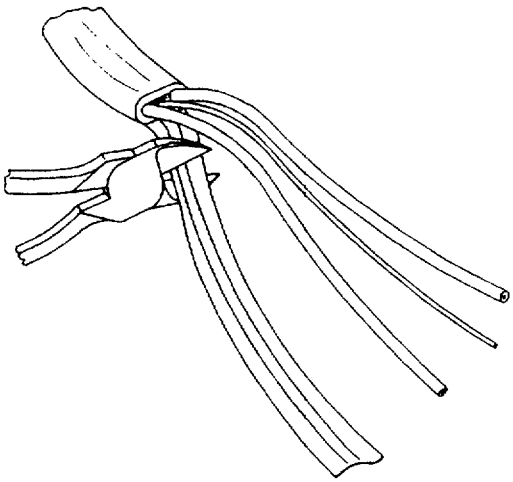
Fig.4. Prior Art
Figure 3:
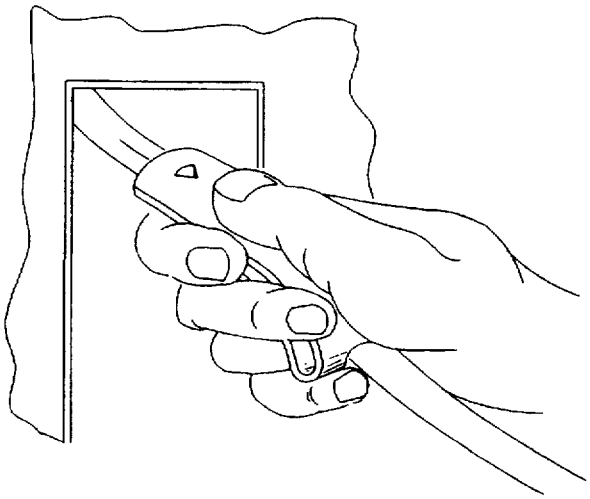
Fig.3. Prior Art
Figure 5:
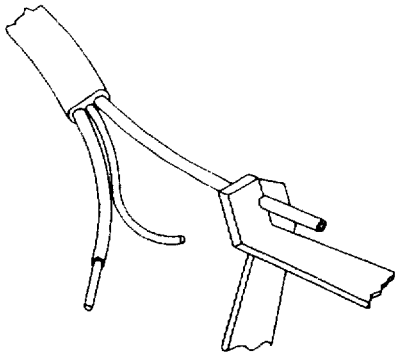
Fig.5. Prior Art
Figure 6:
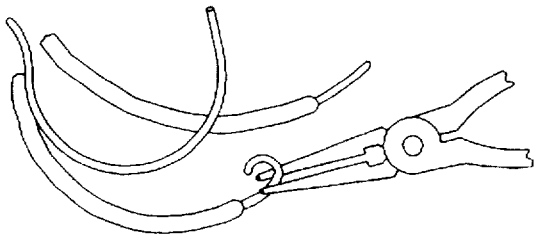
Fig.6. Prior Art
Figure 7:
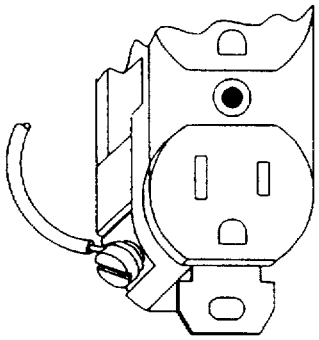
Fig.7 Prior Art
Figure 8:
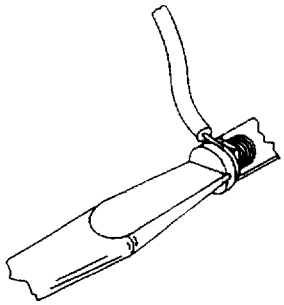
Fig.8. Prior Art
Figure 14:
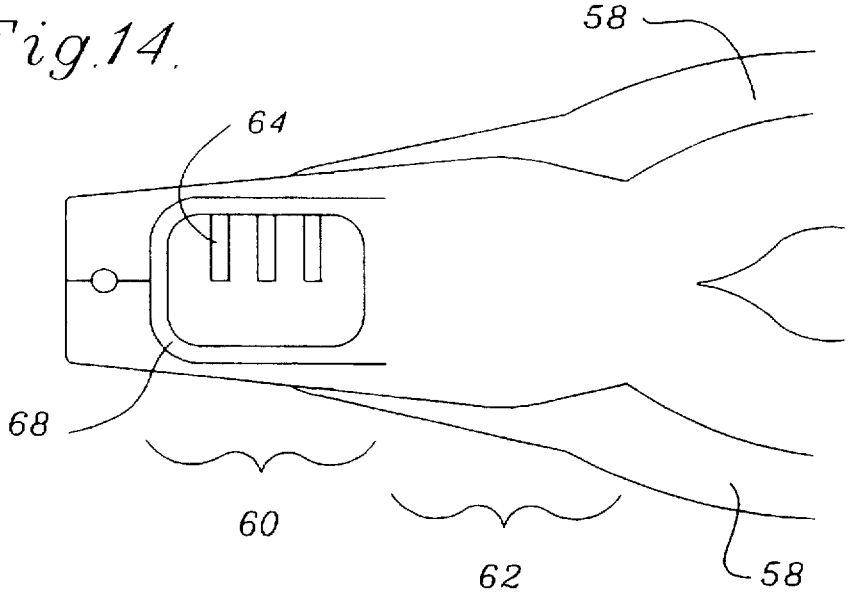
FIG. 14 is a perspective view of a crimping tool which is used to install the male plug of FIGS. 13*a*–13*c* onto the end of a electrical cable.
Figure 9:
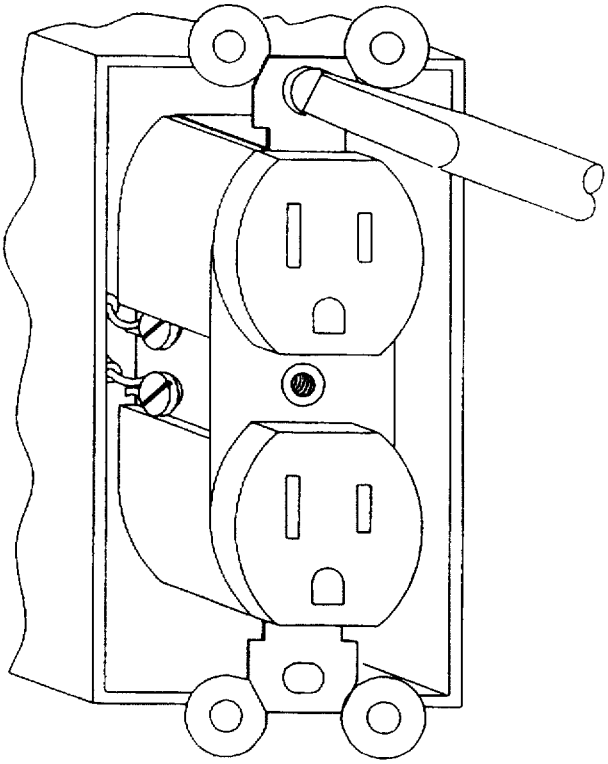
Fig.9. Prior Art
Figure 10:
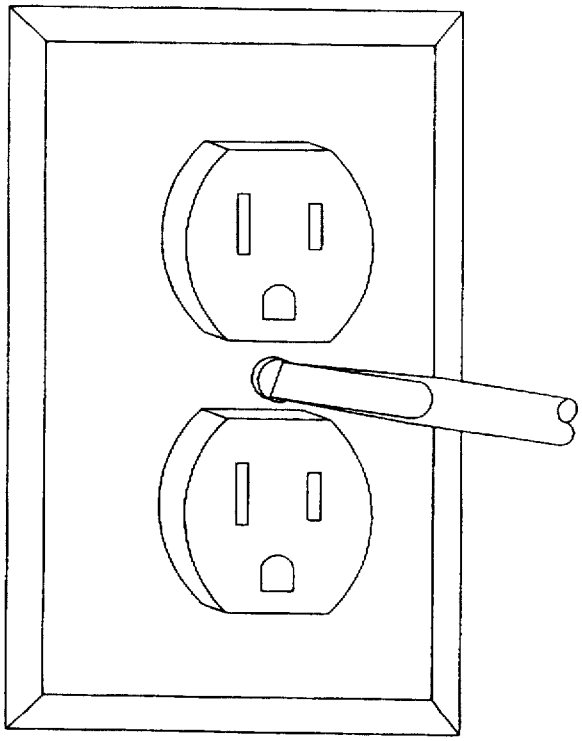
Fig.10. Prior Art

A crimping tool is shown in FIG. 14. The crimping tool is operable to crimp the male plug onto the end of the electrical cable. The crimping tool has two movable handle members 58 as well as a jaw area 60 having two movable members. The handle members are operable to move towards and away from each other between a minimum an maximum displacement respectively. The jaw area 60 has a plurality of crimping members 64, which are operable to engage at least one of the movable terminals of the male plug, and a gripping member 68. The two handles are arranged to move the crimping member and the gripping member in opposition.

The unstripped 73 end of the electrical cable is inserted into opening in the male plug 54. The electrical cable is pushed into the opening until the end of the cable contacts the abutment 59. The opening is formed such that the electrical cable is frictionally engaged in the opening thereby minimizing the possibility that the electrical cable will pull out of the plug before the plug is crimped. The male plug is inserted into the jaw area 60 such that it is firmly retained in the gripping member. The gripping member can also be formed with at least one recess which engages at least one wing member 76 of the plug, similar to the recess 77 formed in the female connector 46, thereby firmly retaining the plug in the gripping member prior to crimping. The handles are moved towards each other which causes at least one of the crimping members to contact the movable terminals of the male plug. As shown in FIG. 13*c*, the movable terminals 56 of the male plug bite through the sheathing 69 and are moved into electrical contact with at least one of the conductors of the electrical cable.

FIG. 13*c* shows the movable terminals being progressively crimped. The left most terminal is shown as not being crimped. All of the terminals are in this position prior to crimping. The center terminal is shown during the crimping process just prior to contacting the a conductor. The right hand terminal is shown in the fully crimped position having passed though the sheathing 69 and insulation 71 of the electrical cable and contacting the conductor.

Figure 13D:
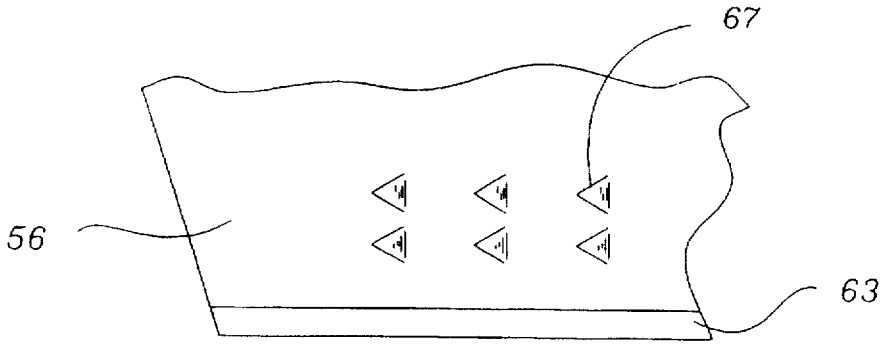
FIG. 13*d* is a partial side view of the movable terminal shown in FIG. 13*a*.

As shown in FIG. 13*d* each one of the movable terminals has a chiseled end 63 and has a conductor contact area 65 which is formed with a plurality of serrations 67 which are operable to grip and make electrical contact with at least one of the conductors as the terminal is moved into contact with the conductor. The movable terminal also has a contact surface 70 which is operable to engage at least one contact 48. As shown in FIG. 13*c*, once the plug is crimped onto the electrical cable, the contact surface is recessed into the channel 61 thereby minimizing the possibility of a short circuit if the plug were to become dislodged from the female connector.

The serrations can be formed as scale-like projections which slide along the conductor as the terminal is moved towards the conductor during crimping, the scale-like serrations biting into the conductor if the terminal is moved in the opposite direction. A variety of end profiles, conductor contact areas and serration formats are possible having such one way biting action.

Additionally the plug can also contain one or more retaining means which serves as a strain relief mechanism. A first retaining means has at least one movable portion 72 which engages with a corresponding crimping member (not shown). The movable portion is operable to contact the sheathing such that the electrical cable is mechanically coupled to the male plug. A second retaining means has at least one wing member 76 which is operable to engage a corresponding recess in the mating female connector 77. Whereas the connectors securely engage the cable and provide a secure tension resistant attachment between the box and the cable connectors, the connectors function in a manner similar to a cable clamp for protecting the circuit from open circuit or shorting problems by application of tension to the cable.

Figure 11E:
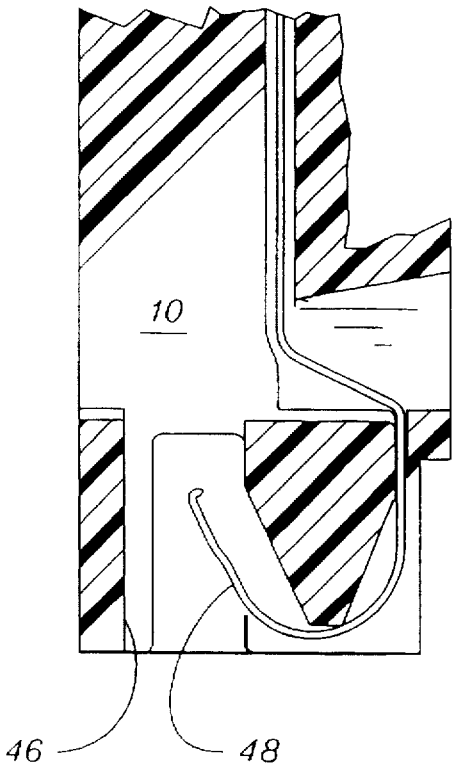
FIG. 11*e* is partial sectional view of the electrical box of FIG. 11*b* showing female connector having a contact which is operable to engage with a terminal of a male plug.
Figure 11F:
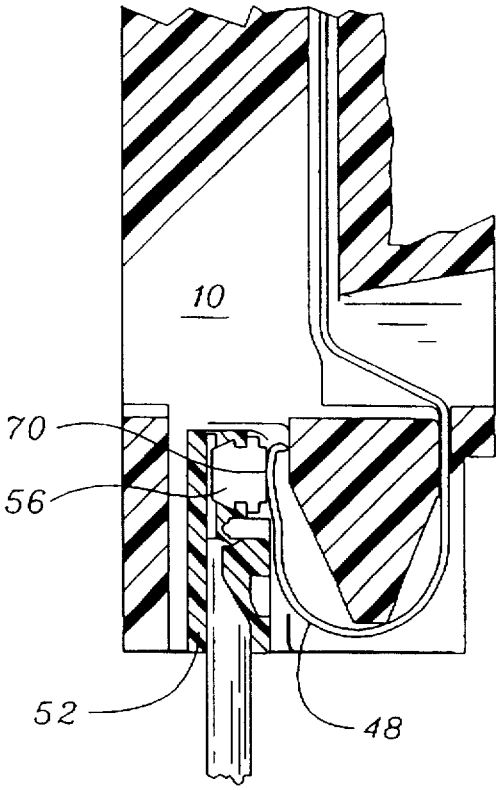
FIG. 11*f* is partial sectional view of the electrical box of FIG. 11*b* showing male plug engaged in the female connector, the contact being engaged with a terminal of a male plug.

FIG. 11*e* shows a partial sectional view of the electrical box 10. As discussed above, the female connector has at least one contact 48 which is operable to engage with a at least one terminal of a male plug. FIG. 11*f* shows a male plug engaged in the female connector, the contact 48 being engaged with a terminal of a male plug. The contact 48 being formed of a resilient spring like material and being sized to fit within the channel 61 so that the contact 48 is firmly pressed against the contact surface 70 of the terminal 56.

Wiring of a branch circuit having four receptacles proceeds as follows. Prior to finishing of the walls (using dry wall panels or plaster or the like), a cable is run from a power source, such as the main service panel, to the designated location for the first receptacle in the branch. Alternatively a cable can be fished after the wall panels are installed. For routes including multiple boxes, the cable is not cut immediately, but instead is left in a slack loop. The cable is further routed to the second, third and fourth designated locations in the branch circuit, etc. and cut off at the last designated location. In order to identify the designated location, a mark can be applied to the floor. The electrical boxes in the branch circuit are not attached to the framing members prior to installation of the wall panels. Preferably the holes for the electrical boxes are cut into the wall panel prior to installing the wall panel. The hole at the first designated location and is positioned between framing studs and can be cut with a razor knife, dry wall saw or the like. Exact measurements as to the location of the electrical box are not required because the holes do not have to line up with a framing member or a previously attached and protruding electrical box. After the holes are cut, the wall panel is moved into position, the slack loop is pulled though the hole, and the wall panel is attached. Since nothing is attached to the framing members prior to installation of the wall panel, the wall panel will rest flush against the framing members and is easily attached. Alternatively the hole can be cut in the wall panel after the wall panel is installed. Once the hole is cut the slack loop is located and pulled though the hole. As discussed above, misalignment of the hole and the box is not a problem.

Figure 15:
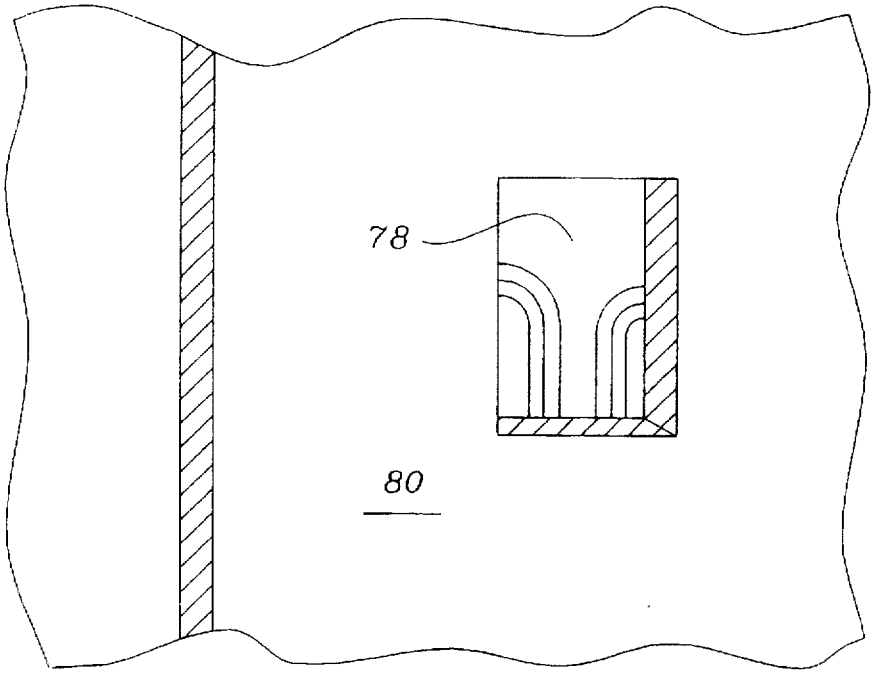
FIG. 15 is a perspective view of a electrical cable that is installed behind the wall, the wall having a hole which can receive an electrical box.
Figure 16:
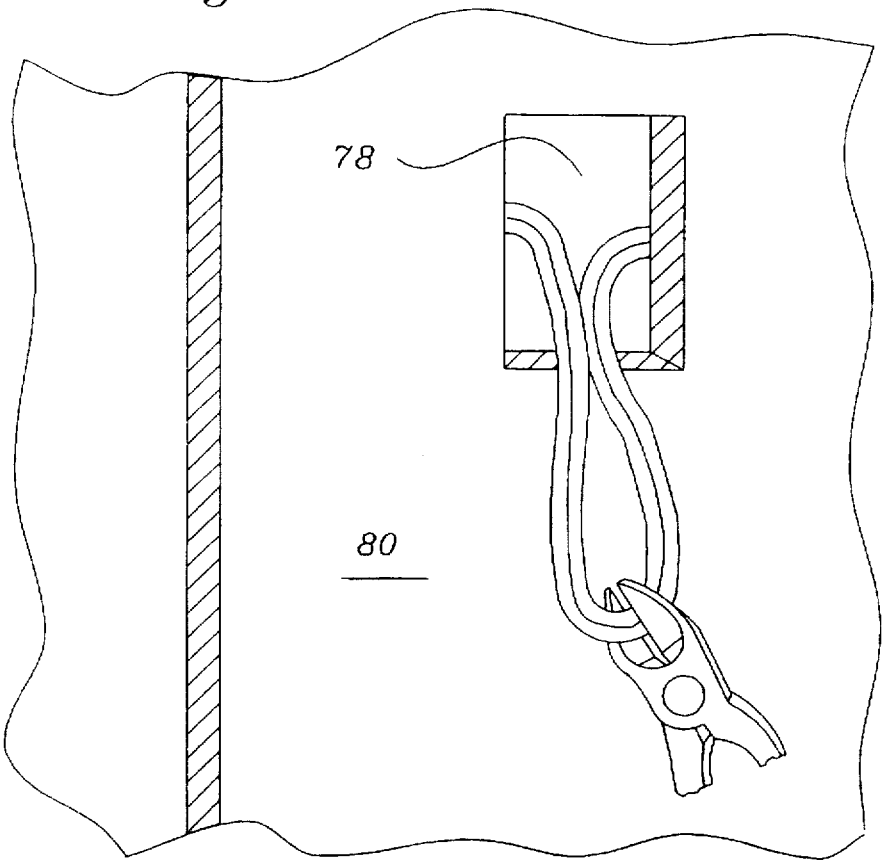
FIG. 16 is a perspective view of the electrical cable of FIG. 15, a loop of the cable is pulled out through the hole and is cut using a pair of diagonal cutters.
Figure 17:
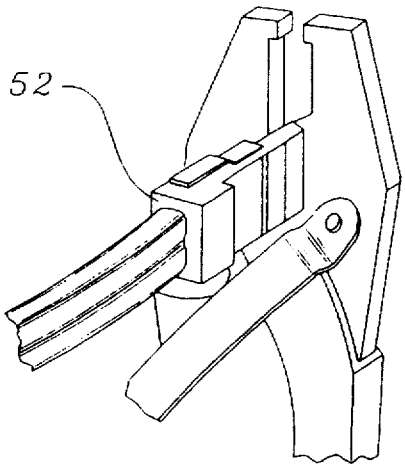
FIG. 17 is a perspective view of the crimping tool of FIG. 14 which is used to install the male plug of FIG. 13 onto the end of the electrical cable of FIG. 16.

FIG. 15 shows a hole 78 in a wall 80 behind which is located a previously routed electrical cable. The cable is pulled out through the hole in the wall as shown in FIG. 16. The electrical cable is cut, e.g., with a pair of diagonal cutters or the like. Both ends of the electrical cable are attached to male plugs using the crimping tool discussed above as shown in FIG. 17. The sheathing is not removed and the individual insulated conductors are not stripped of insulation. The cable is simply inserted into the opening in the male plug and the male plug is crimped onto the end of the cable to achieve electrical connection.

Figure 18:
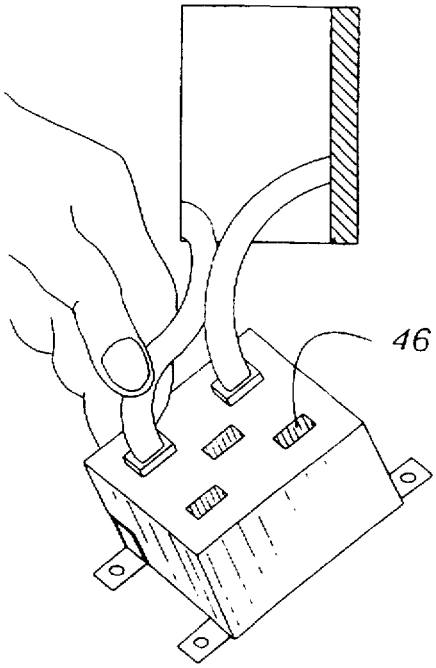
FIG. 18 is a perspective view the electrical box of FIG. 11, the two cut ends of the electrical cable of FIG. 16 have male plugs installed and are mated with the female connectors in rear of the box.

The male plug coupled to the length of cable routed to the main service panel is plugged into one of the "COMMON" connectors on the back of the first electrical box pre-wired with a receptacle (first receptacle box). The plug coupled to the length of cable routed to the designated location for the second receptacle is also plugged into one of the "COMMON" connectors of the first receptacle box as shown in FIG. 18.

Figure 12:
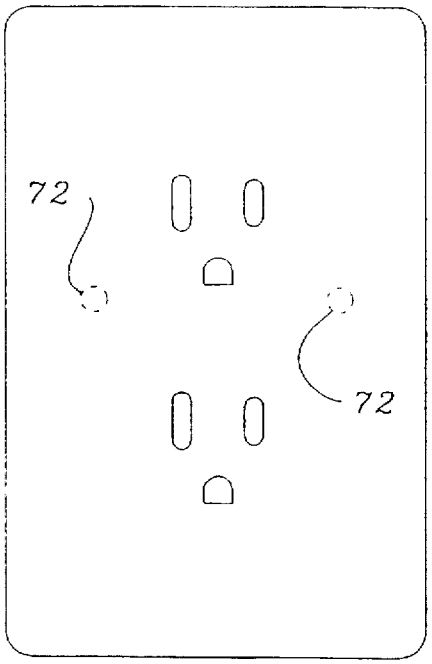
FIG. 12 is front view of a cover plate in accordance with invention.
Figure 19:
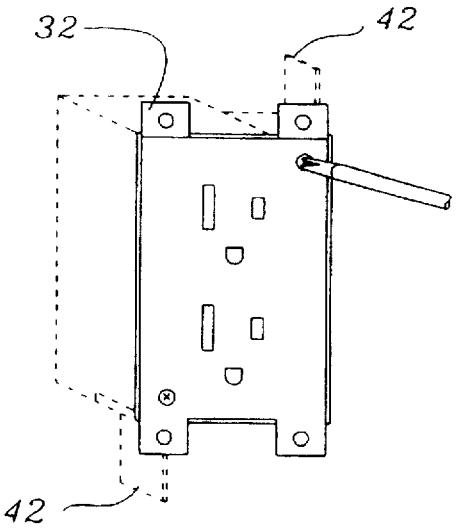
FIG. 19 is a front view of the electrical box, the box is installed in the hole in the wall and the retaining means are engaged by tightening screws with a screw driver.

The first receptacle box is inserted into the hole and the retaining means is engaged so that the box is firmly retained in the wall as shown in FIG. 19. A cover plate, as shown in FIG. 12, is then installed thereby covering the front surface of the electrical box so as to present a finished appearance. The cover plate has at least one fastener 74 which is operable to couple the cover plate to the electrical box. The cover plate positioned over the front surface of the electrical box and the fasteners are engaged in holes 36 formed in the front surface of the electrical box. Alternatively, other means can be used to secure the cover plate for example frictionally engaging tabs formed in the periphery electrical box which engage a recessed portion of the cover plate (not shown).

The same procedure is followed for the remaining three receptacles in the branch circuit according to this example. However the last receptacle only requires one plug coupled to the previously cut end of the electrical cable. This plug is inserted into the COMMON connector of the fourth receptacle box and no connection made is made to the other COMMON connector.

The electrical box is suitable for use with a variety of electrical devices such as a standard duplex receptacle as discussed above as well as a duplex receptacle operated in two-wire mode, ground fault receptacles, standard light switch or dimmer switches, three-way switches, four way switches, junctions and combinations of these elements. Regardless of which electrical device is installed in the box, the plurality of female connectors are labeled with indicia allow the box to easily wired to a branch circuit.

Figure 20:
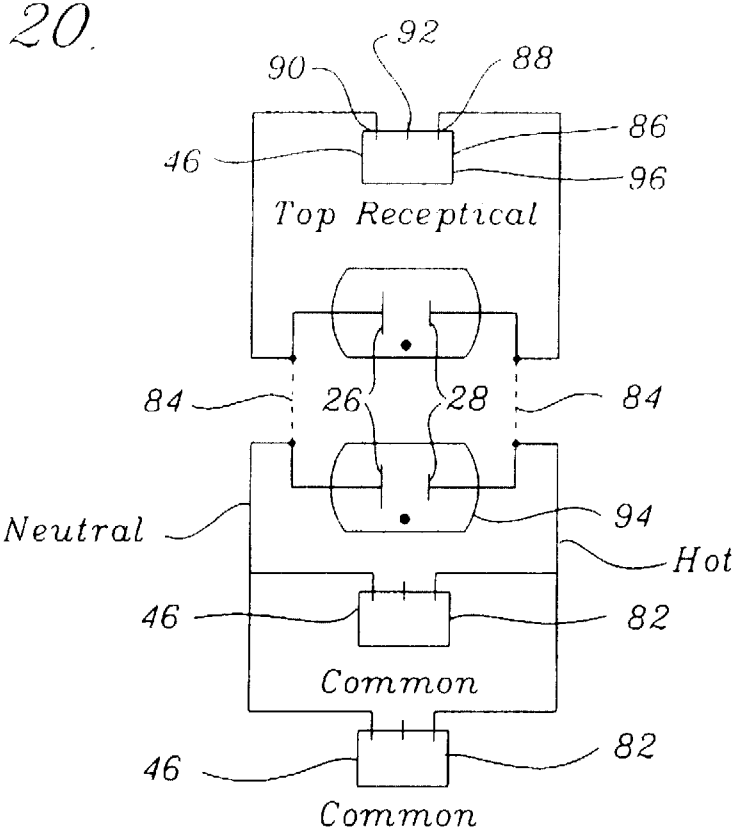
FIG. 20 is a schematic diagram of the wiring within an electrical box in accordance with the invention, the box being pre-wired with a duplex receptacle.

The connections between the electrical device and the plurality of contacts of the female connectors is pre-wired. The wiring within the box as well as the wiring of a branch circuit changes depending on the type of electrical device installed in the box. FIG. 20 shows a schematic diagram of the wiring within an embodiment of an electrical box which has a duplex receptacle installed (receptacle box). Each female connector 46 has at least one hot contact 88 which is coupled to the hot conductor of the branch circuit, a neutral contact 90 which is coupled to the neutral conductor of the branch circuit and a ground contact 92 which is coupled to the ground conductor of the branch circuit. The ground connections are omitted for clarity. The two COMMON connectors 82 are wired to the lower receptacle 94. The upper receptacle 96 is connected to the TOP RECEPTACLE connector 86. The long slot 26 corresponds to the neutral conductor and the short slot 28 corresponds to the hot conductor, which renders the connectors asymmetrical and only connectable in one way. Each of the connectors has three terminals 48 corresponding to hot neutral and ground. The duplex receptacles can also be connected in a two-wire mode.

In two-wire mode, the break away fin 84, which electrically couples the upper and lower receptacle, is broken away. A small hole (not shown) is provided in the body of the box which allows a slotted screw driver or the like to be inserted into the body of the box in order to remove the break away fin. The lower receptacle can be wired in a branch circuit by coupling at least one electrical cable to a COMMON connector as discussed above. An additional cable is required to provide power to the upper receptacle. The power for the upper receptacle can be provided from a standard switch or dimmer, or the upper receptacle can receive constant power from a different power source such as another branch circuit.

Figure 21:
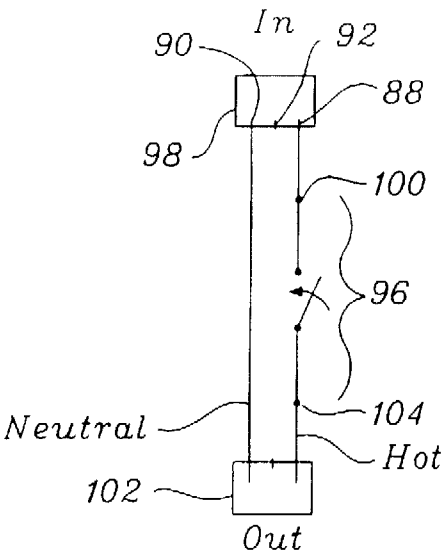
FIG. 21 is a schematic diagram showing the wiring within an electrical box in accordance with the invention, the box being pre-wired with a standard light switch.

FIG. 21 shows a schematic diagram of the wiring within an embodiment of an electrical box which has a standard switch installed (switch box). Each female connector 46 has at least one hot contact 88 which is coupled to the hot conductor of the branch circuit, a neutral contact 90 which is coupled to the neutral conductor of the branch circuit and a ground contact 92 which is coupled to the ground conductor of the branch circuit. The hot contact of the IN connector 98 is connected to a first terminal of the switch 100. The neutral contact IN connector is coupled to the neutral contact of the OUT connector. The hot contact of the OUT 102 connector is connected to a second terminal of the switch 104. The ground contacts of IN and OUT connectors are coupled together and also to the ground terminal of the switch (not shown).

A branch circuit for operating a duplex receptacle in two-wire mode is wired as follows. A first cable is run from the main service panel or another electrical box in the branch circuit to the designated location for the switch box. The first cable is attached to a male plug which is subsequently mated to the IN connector of the switch box. A second cable is run from the designated location for the switch box to the designated location for the receptacle box which is to be operated in two-wire mode. As discussed above, the break away fin is removed from the receptacle box thereby electrically isolating the upper and lower receptacle. One end of the second cable is attached to a male plug which is subsequently mated to the OUT connector of the switch box. The opposite end of the second cable is attached to a male plug which is subsequently mated to the TOP RECEPTACLE connector of the receptacle box. The upper receptacle is controllable via the switch, independent of the lower receptacle.

A dimmer switch or the like can be installed in place of the standard switch in like manner. It is also apparent that the wiring of a switched receptacle is similar to wiring an electrical box which is to be connected to a lighting fixture. The second cable is routed from the OUT terminal of the switch to a standard electrical box which is operable to accept a lighting fixture.

Figure 22:
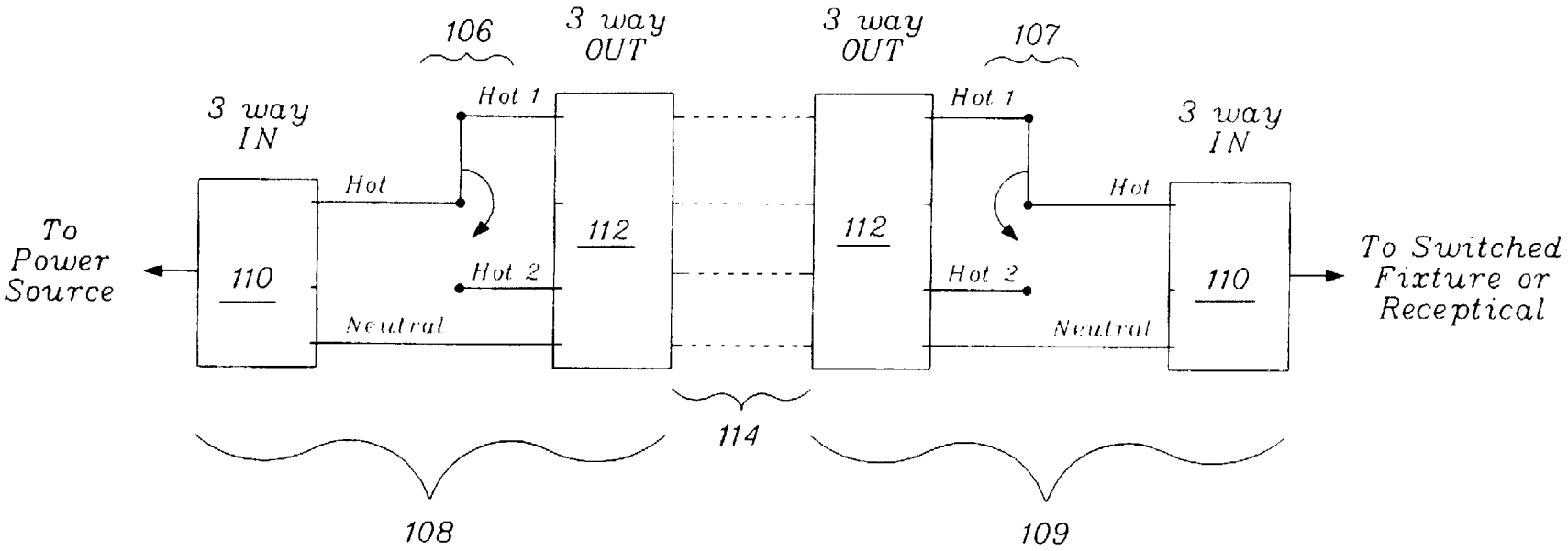
FIG. 22 is a schematic diagram showing the connections in a three way lighting circuit having two three way switches.

The electrical box can also be used with three way lighting switches. FIG. 22 shows a schematic diagram of a three way lighting circuit. The wiring within an embodiment of an electrical box which has a three way switch installed (three way switch box) is also shown. A three way switch is used to provide two light switches for controlling one lighting fixture or switched receptacle. Three way switches 106, 107 are installed in pairs, each switch having three terminals. As shown in FIG. 22, a three way switch is a double pole single throw switch. The pair of identical three way switch boxes 108, 109 as shown in FIG. 22 are operated in mirror image fashion.

The 3 WAY IN connector 110 has three contacts however the 3 WAY OUT 112 connector has four contacts. Therefore the male plug and the electrical cable 114 which couples to the 3 WAY OUT connector also has four terminals and contacts respectively. Electrical cables such as 12 gauge three wire plus ground non-metallic sheathed cable is suitable for this purpose. Three wire cable adds a third insulated conductor which is typically covered in red colored insulation and is normally used as a second hot conductor.

The three way switch boxes are internally wired as follows. The hot contact of the 3 WAY IN connector is coupled to the center terminal of the switch. The two outer terminals of the three way switch are designated Hot 1 and Hot 2. Hot 1 and Hot 2 as well as the neutral conductor from 3 WAY IN are coupled to the Hot 1, Hot 2 and neutral contacts of the 3 WAY OUT connector respectively. The ground contacts of the 3 WAY IN and 3 WAY OUT connectors are coupled together and also to the ground terminal of the three way switch (not shown).

As shown in FIG. 22 the center terminal of the first switch 106 is designated as the input terminal. The center terminal of the second switch 107 is designated as the output terminal. The hot conductor from an electrical cable routed from a power source is coupled, via a male plug, to the 3 WAY IN terminal of the first three way switch box 108.

A first end of a three wire cable is coupled to the 3 WAY OUT connector of the first switch box via a male plug. The opposite end of the three wire cable is coupled to the 3 WAY OUT connector of the second switch box 109. The hot conductor from an electrical cable which is to be routed to a switched fixture or receptacle is coupled, via a male plug, to the IN terminal of the second three way switch box.

FIG. 22 shows the electrical path which is conducting along hot 1 of the two switches (i.e., the lighting fixture is on). If the first switch is moved, the electrical path along hot 1 is broken and the fixture would be off. If the second switch is then moved, there would be an electrical path conducting along hot 2 and the light would again be on.

It will be appreciated that the invention is suitable for use with other electrical devices such as four way switches. It is also appreciated that the invention is suitable for use as a junction box. A junction box has a plurality of female connectors. The hot, neutral and ground contacts of one of the female connectors is joined to the other hot, neutral and ground terminals each of the other female connectors respectively.

It is also appreciated that the invention can be configured to provide an electrical box suitable for coupling to a lighting fixture. The electrical box has at least one female connector and at least one threaded hole for attaching a standard light fixture. The hot, neutral and ground contacts of the female connector are joined to lengths of wire which are coupled to the existing lighting fixture with wire nuts, or screws or the like.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

We claim:

1. A means for wiring a branch circuit comprising:

an electrical box which is pre-wired with a terminal element forming at least one of a junction, an outlet operable to receive a standard AC line plug and a switch, the electrical box having an outer surface with at least one connector having at least one of a male or female contact, wherein the contact and at least one of the outlet, switch and junction are electrically coupled, an insulated electrical cable having at least one end and at least two individually insulated conductors which are encased in an outer sheath, the at least one end being unstripped, the insulated conductors and the outer sheath fully extending to the end of the electrical cable, a female or male plug complementary to said at least one of a male or female contact, the plug being connectable to the unstripped end of the electrical cable, wherein the plug has at least one terminal that is electrically coupled to the conductor, the plug being operable to mate with the connector, the terminal making an electrical connection with the contact, thereby electrically connecting the conductor to at least one of the junction, the outlet and the switch.

2. The means for wiring a branch circuit of claim 1 wherein the box further comprises a retaining means for coupling the electrical box to at least one of a wall and a framing member.

3. The means for wiring a branch circuit of claim 2 wherein the retaining means couples the electrical box to the wall.

4. The means for wiring a branch circuit of claim 1 wherein the terminal element is pre-wired for grounded 110–120 volt AC service.

5. The means for wiring a branch circuit of claim 1 wherein the terminal element is pre-wired for grounded 220–240 volt AC service.

6. The means for wiring a branch circuit of claim 1 wherein the box has a front surface which is substantially aligned with the terminal element.

7. The means for wiring a branch circuit of claim 1 wherein the connector has a hot contact, a neutral contact and a ground contact.

8. The means for wiring a branch circuit of claim 7 wherein the terminal element has a hot terminal, a neutral terminal and a ground terminal.

9. The means for wiring a branch circuit of claim 8 wherein the hot contact, the neutral contact and the ground contact of the connector are electrically coupled to the hot terminal, the neutral terminal and the ground terminal, respectively, of at least one of the junction, the receptacle and the switch.

10. The means for wiring a branch circuit of claim 1 comprising a first said connector having a hot contact, a neutral contact and a ground contact and a second said connector having a first hot contact, a second hot contact, a neutral contact and a ground contact.

11. The means for wiring a branch circuit of claim 10 wherein the terminal element comprises a three way switch having a first hot terminal, a second hot terminal, a neutral terminal and a ground terminal.

12. The means for wiring a branch circuit of claim 11 wherein the hot contact of the first said connector is electrically coupled to the neutral terminal of the switch, the neutral contact of said first connector is electrically coupled to the neutral contact of the second said connector, the ground contact of said first connector is electrically coupled to the ground terminal of the switch and to the ground contact of said second connector, the first hot terminal is electrically coupled to the first hot contact of said second connector and the second hot terminal is electrically coupled to the second hot contact of said second connector.

13. The means for wiring a branch circuit of claim 1 wherein the plug further comprises a first retaining means which means which mechanically couples the plug to at least one of the conductors, the insulation and the sheathing of the electrical cable.

14. The means for wiring a branch circuit of claim 1 wherein the plug further comprises a second retaining means which cooperates with the connector such that when the plug is mated with the connector, the plug and the electrical cable are mechanically attached to the electrical box.

15. The means for wiring a branch circuit of claim 1 wherein the plug further comprises indicia symbolizing the orientation of the plug with respect to at least one of the conductors of the electrical cable.

16. The means for wiring a branch circuit of claim 1 wherein the electrical box is labeled with indicia associated with the connector for indicating particular connections to be made with the electrical box.

17. The means for wiring a branch circuit of claim 16 wherein the indicia symbolizes the wiring connections made between the contact and at least one of the outlet, switch and junction.

18. A means for wiring a branch circuit comprising:

an electrical box which is pre-wired with a terminal element forming at least one of a junction, an outlet operable to receive a standard AC line plug and a switch, the electrical box having an outer surface with at least one connector having at least one of a male or female contact, wherein the contact and at least one of the outlet, switch and junction are electrically coupled, an insulated electrical cable having at least two individually insulated conductors which are encased in an outer sheath, the insulated electrical cable having at least one end formed by a substantially transverse cut, the insulated conductors and the outer sheath fully extending to the end of the cable to form an unstripped end of the electrical cable, a female or male plug complementary to said at least one of a male or female contact, the plug being connectable to the unstripped end of the electrical cable, wherein the plug has at least one terminal that is electrically coupled to the conductor, the plug being operable to mate with the connector, the terminal making an electrical connection with the contact, thereby electrically connecting the conductor to at least one of the junction, the outlet and the switch.

* * * * *

UNITED STATES PATENT AND TRADEMARK OFFICE

CERTIFICATE OF CORRECTION

PATENT NO. : 5,785,551

DATED : July 28, 1998

INVENTOR(S) : Robert A. Libby

It is certified that error appears in the above-identified patent and that said Letters Patent is hereby corrected as shown below:

Column 2, line 32, "though" should read "through"
Column 2, line 41, "though" should read "through"
Column 4, line 33, "isolates" should read "isolate"
Column 4, line 33, "allows" should read "allow"
Column 5, line 7, "an" should read "and"
Column 5, line 50, "in" should be deleted
Column 5, line 60, "walls" should read "wall"
Column 6, line 67, insert --a-- after "as"
Column 8 line 35, insert --a-- after "is"
Column 8, line 37, insert --a-- after "is"
Column 8, line 41, insert --a-- after "is"
Column 8, line 43, insert --a-- after "is"
Column 8, line 44, insert --a-- after "showing"
Column 8, line 46, insert --a-- after "is"
Column 8, line 47, insert --a-- after "showing"
Column 8, line 50, insert --a-- after "is"
Column 8, line 52, insert --of-- after "view"
Column 8, line 64, "a" should read "an"
Column 8, line 65, "a" should read "an"
Column 9, line 2, insert --where-- after "15,"
Column 9, line 7, insert --where-- after "FIG. 11,"
Column 9, line 10, insert --the-- before "rear"
Column 9, line 47, delete "a"
Column 9, line 59, "though" should read "through"
Column 10, line 1, delete "a"
Column 11, line 33, "an" should read "and"
Column 11, line 64, delete "a"
Column 11, line 66, "though" should read "through"
Column 12, line 36, delete "a"
Column 12, line 59, insert --is cut-- after "hole"
Column 12, line 66, "though" should read "through"
Column 13, line 5, "though" should read "through"

UNITED STATES PATENT AND TRADEMARK OFFICE

CERTIFICATE OF CORRECTION

PATENT NO. : 5,785,551

DATED : July 28, 1998

INVENTOR(S) : Robert A. Libby

It is certified that error appears in the above-identified patent and that said Letters Patent is hereby corrected as shown below:

Column 13, line 46, delete "made" after "connection"
Column 13, line 56, insert --to-- before "allow"
Column 14, line 9, insert --,-- after "hot"
Column 16, line 7, "We" should read "I"

Signed and Sealed this

Second Day of February, 1999

*Attest:*

*Attesting Officer*

*Acting Commissioner of Patents and Trademarks*